United States Patent [19]

Kudoh

[11] Patent Number: 4,918,729

[45] Date of Patent: Apr. 17, 1990

[54] VOICE SIGNAL ENCODING AND DECODING APPARATUS AND METHOD

[75] Inventor: Norimasa Kudoh, Kawasaki, Japan

[73] Assignee: Kabushiki Kaisha Toshiba, Kawasaki, Japan

[21] Appl. No.: 291,934

[22] Filed: Dec. 30, 1988

[30] Foreign Application Priority Data

Jan. 5, 1988 [JP] Japan ..... 63-523

[51] Int. Cl.[4] ..... G10L 5/00

[52] U.S. Cl. ..... 381/36; 381/47

[58] Field of Search ..... 381/30–38, 381/47

[56] References Cited

U.S. PATENT DOCUMENTS 4,672,670 6/1987 Wang et al. ..... 381/36

4,710,960 12/1987 Sato ..... 381/47

*Primary Examiner*—Emanuel S. Kemeny

*Attorney, Agent, or Firm*—Finnegan, Henderson, Farabow, Garrett and Dunner

[57] ABSTRACT

A voice signal encoding and decoding apparatus and method which attenuates rapidly a voice signal when there occurs an error in transmission by giving increased robustness to the transmission error. It comprises an encoding section which includes a predictive filter for computing a predicted value of an input signal to the encoding section, and an encoder for encoding a difference signal obtained by subtracting from the input signal the predicted value predicted by the predictive filter; and a decoding section which includes a decoder for decoding a received difference signal, a detector which detects an error in the received signal, and a predictive synthesizing filter for computing the predicted value of the output signal from the sum of the signal decoded by the decoder and the computed prediction value of the output signal, and having a resonant frequency band width expanding when an error is detected by the error detector.

8 Claims, 3 Drawing Sheets

VOICE SIGNAL ENCODING AND DECODING APPARATUS AND METHOD

BACKGROUND OF THE INVENTION

1. Field of the Invention

The present invention relates to voice signal encoding and decoding apparatus and methods suitable for use in various communication devices,. etc., and more particularly to voice signal encoding and decoding apparatus and methods which rapidly attenuate an erroneous influence when there is an error in transmission and provides robustness to such error in transmission.

2. Description of the Related Art

FIG. 1 shows a proposed voice signal encoding and decoding apparatus which is called an voice codec and which includes an encoding section 1 and a decoding section 2. In FIG. 1, the encoding section 1 of a transmitter side and the decoder section 2 of a receiver side only are shown, but actually, the transmitter also has a decoding section similar to that of the receiver and the receiver also has an encoding section similar to that of the transmitter. The encoding section 1 of the transmitter and the decoding section 2 of the receiver are connected via a transmission channel 3. The encoding section 1 includes an input terminal 4, a buffer 5, a predicted parameter computer 6, a subtractor 7, a quantizer 8, an inverse-quantizer 33, an adder 9, a predictive filter 10, encoders 11, 13 and a multiplexer (MPX) 12.

An input voice signal x received at the input terminal 4 is delivered to the buffer 5 where only a predetermined number of processed samples of the input signal is stored. The predicted parameter computer 6 computes a predicted parameter which eliminates the stochastic redundancy of the input voice signal x by using the predetermined number of samples of the input voice signal x stored in the buffer 5. The output signal of the buffer 5 is applied to the subtractor 7 which subtracts from the output signal of the buffer 5 a predicted value $\bar{x}$ output of the predictive filter 10 to provide a prediction difference d. The output signal of the subtractor 7 is applied to the quantizer 8 which quantizes the prediction difference d from the subtractor 7. The output $\hat{d}$ of the quantizer 8 is applied via the inverse-quantizer 33 to the adder 9, which adds the quantized prediction difference $\hat{d}'$ and the predicted value $\bar{x}$ to produce a locally decoded signal $\hat{x}$. The output signal $\hat{x}$ is applied to the predictive filter 10.

The predictive filter 10 receives the predictive parameter calculated by the predicted parameter computer 6 and computes a predicted value $\bar{x}$ in accordance with the signal $\hat{x}$ and the predicted parameter.

The output $\hat{d}$ from the quantizer 8 is applied to the encoder 11, which encodes the quantized difference $\hat{d}$.

The output from the predicted parameter computer 6 is applied to the encoder 13, which encodes a predicted parameter output by the predicted parameter computer 6. The multiplexer 12 produces formatted data, as shown in FIG. 2, from the data encoded by the encoders 11 and 13. As shown in FIG. 2, the data includes a synchronizing pattern 19, a side information section 20 and a main information section 21. The synchronizing pattern 19 shows the beginning of a frame. The side information section 20 includes data such as the predicted parameter, power and the fundamental voice frequency (pitch), etc. The main information section 21 includes the prediction difference.

The decoding section 2 includes a demultiplexer (DEMPX) 14, decoders 15, 15*a*, and an adder 16, a predictive synthesizing filter 17, and an output terminal 18. The demultiplexer 14 divides into sub-fields a frame received through the transmission channel 3. The decoder 15 decodes data existing in a divided sub-field and outputs a prediction difference $\hat{d}'$. The decoder 15*a* decodes a predicted parameter.

The adder 16 adds the prediction difference $\hat{d}'$ and a predicted value $\bar{x}$ produced by the predictive synthesizing filter 17 to produce an output voice signal $\hat{x}'$, which is then output from the output terminal 18.

The predictive synthesizing filter 17 generates a predicted value $\bar{x}'$ from the output voice signal $\hat{x}'$ and the predicted parameter decoded by the decoder 15*a*.

In summary, the predicted value $\bar{x}$ is subtracted by the subtractor 7 from the input voice signal stored in the buffer 5 and the resulting prediction difference d is input to and quantized by the quantizer 8. The output from the quantizer is encoded by the encoder 11, and output by the multiplexer 12 as frame data such as shown in FIG. 2 to the transmission channel 3.

The frame data received by the transmission channel 3 is divided by the demultiplexer 14 into respective sub-fields data segments, which are then decoded by the decoder 15. The predicted value $\bar{x}'$ is added by the adder 16 to the output from the decoder 15, and the resulting signal is output as an output voice signal $\hat{x}'$ to the output terminal 18.

If an error occurs in transmission in the use of such conventional voice codec, noise or rasping voice is output from the decoder 2. The influence of such error will appear on the outputs in the future as well as at present. Therefore, an attempt has been made to produce the silence when there occurs a transmission error, but a sensation of hearing is not good.

Namely, the conventional voice codec is vulnerable to a transmission error and the influence of the error tends to continue still in the future.

The present invention perceives such problems. It is an object of the present invention to provide an voice signal encoding and decoding apparatus and method which has great robustness to errors in transmission.

SUMMARY OF THE INVENTION

In order to achieve the above object, according to the present invention, there is provided a voice signal encoding and decoding apparatus comprising an encoding section which includes a predictive filter which computes a predicted value of an input signal to the encoding section and an encoder which encodes a difference signal derived by subtraction, from the input signal, of the predicted value computed by the predictive filter; and a decoding section which includes a decoder which decodes a received difference signal, an error detector which detects an error in the received signal, and a prediction synthesizing filter which computes a predicted value of the output signal from the sum of the signal decoded by the decoder and the predicted value of the computed output signal, the filter having a resonant frequency band width which expands when an error is detected by the error detector.

When an error in the signal received is detected by the error detector of the decoding section, the resonant frequency band width of the predictive synthesizing filter is expanded, namely, the Q value, which indicates the sharpness of resonance of the predictive synthesizing filter is reduced, so that the voice is rapidly attenuated.

In summary, according to the present invention, if a transmission error is detected, the resonant frequency band width of the predictive synthesizing filter is expanded, and thus an voice signal encoding and decoding apparatus having great robustness to transmission errors is provided.

DESCRIPTION OF THE PREFERRED EMBODIMENT

Figure 1:
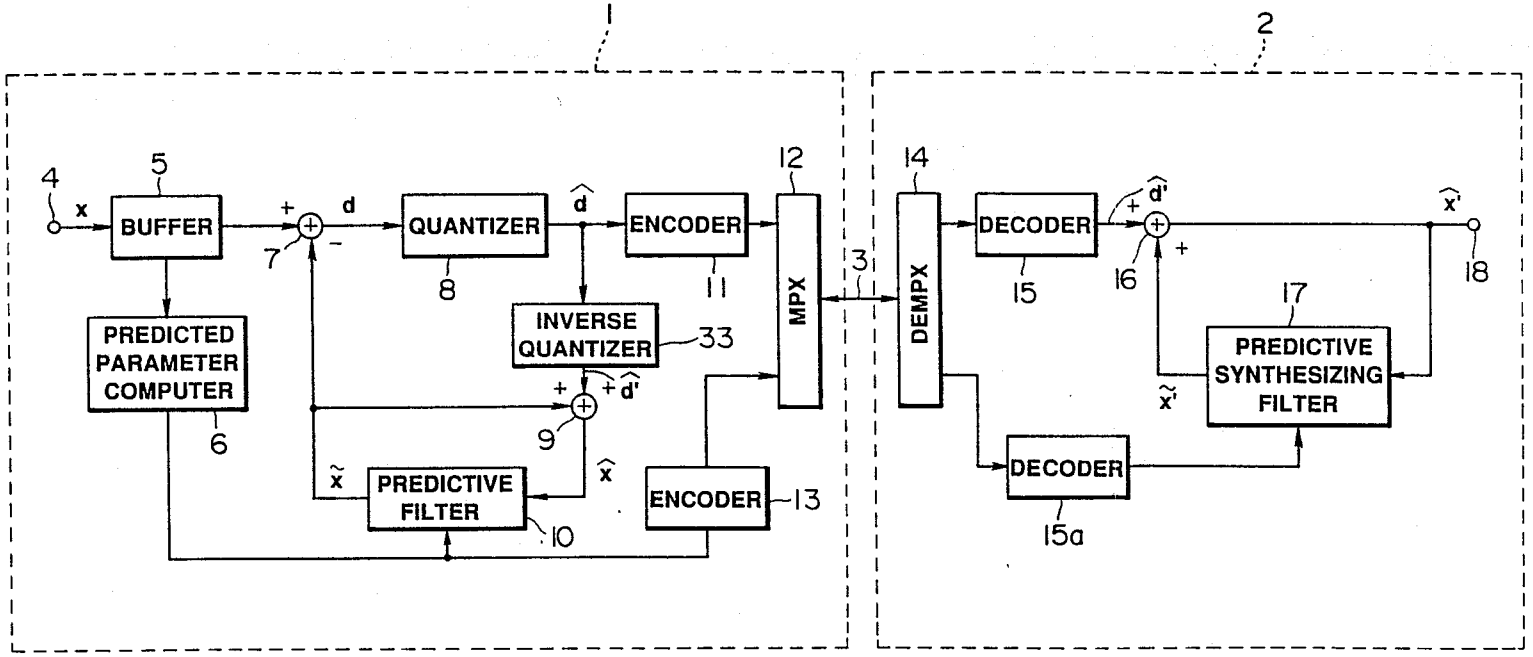
FIG. 1 is a block diagram showing the structure of a voice codec.
Figure 2:
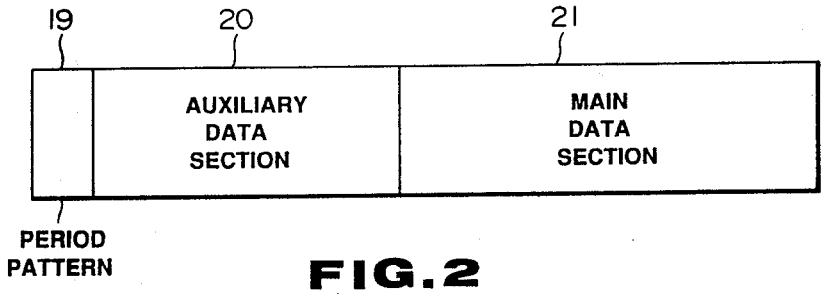
FIG. 2 illustrates the format of an output frame of a multiplexer in the structure of FIG. 1.
Figure 5:
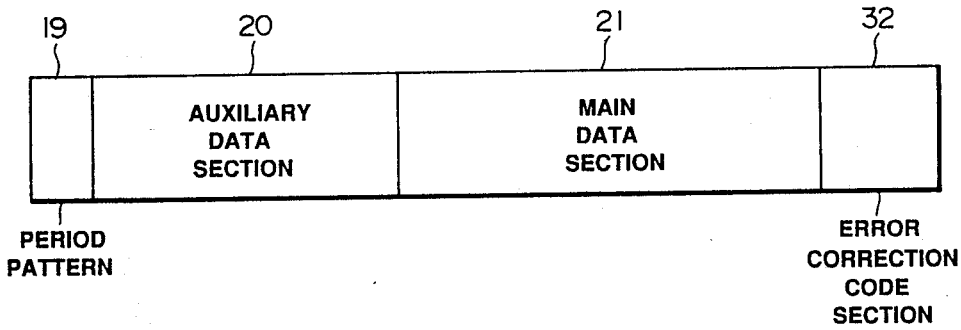
FIG. 5 illustrates the format of an output frame of a multiplexer in the structure of FIG. 3.
Figure 3:
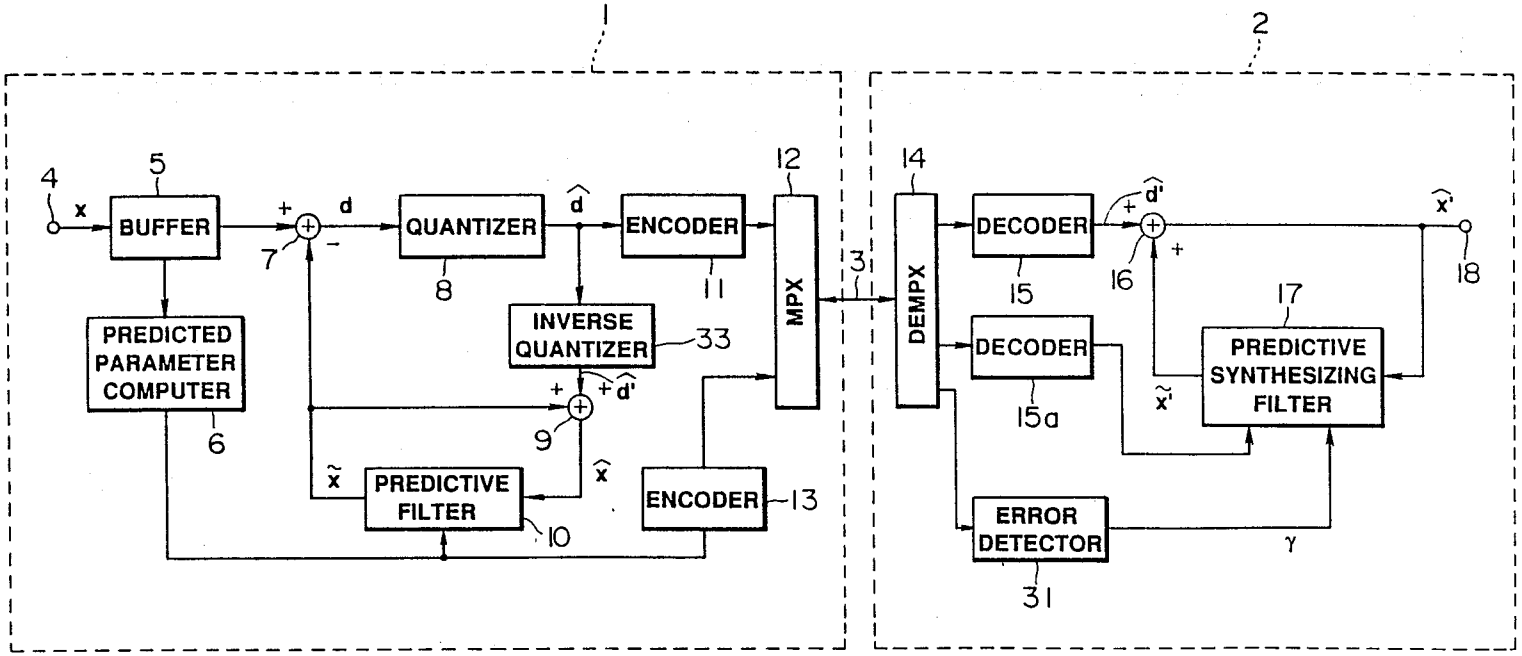
FIG. 3 is a block diagram showing the structure of a voice codec according to one embodiment of the present invention.

One embodiment of the present invention will now be described in detail with reference to the drawings. FIG. 3 shows in block diagram the structure of a voice codec according to one embodiment of the present invention. The same reference numeral is used to identify elements having the same function throughout FIGS. 1 and 3 for convenience of explanation. The decoding section of the particular embodiment of FIG. 3 is composed of the decoding section 2 of FIG. 1 and an error detector 31. The embodiment also includes an error correction code section. The multiplexer 12 of the endoding section 1 generates a well-known error correction code to allow the decoding section 2 to correct a possible data error in the data output by the multiplexer 12, and transmits the error correction code together with the transmitted data. One example of the data output by the multiplexer 12 is shown in FIG. 5. The data output from the multiplexer 12 has a format including a synchronizing pattern 19, side information section 20, a main information section 21 and an error correction code section 32, as shown in FIG. 5.

In the embodiment shown in FIG. 3, the input voice signal x received at the input terminal 4 is input to the buffer 5 where a predetermined number of processed data samples of the signal is stored. The predicted parameter computer 6 computes a predicted parameter to eliminate the redundancy of the input voice signal x by using the predetermined number of data samples of the input voice signal x stored in the buffer 5. The output signal from the buffer 5 is applied to the subtractor 7 which subtracts the predicted value $\bar{x}$ output of the predictive filter 10 from the output signal of the buffer 5 to produce a prediction difference d. The output signal of the subtractor 7 is applied to and quantized by the quantizer 8. The output $\hat{d}$ of the quantizer 8 is applied to the adder 9 in which the quantized prediction difference d and the predicted value $\bar{x}$ are added via the inverse-quantizer 33 to produce a locally decoded signal $\hat{x}$. The output signal $\hat{x}$ from the adder 9 is applied to the predictive filter 10 which computes the predicted value $\bar{x}$ by using the signal $\hat{x}$ and the predicted parameter computed by the predicted parameter computer 6.

The outputs from the quantizer 8 and the predicted parameter computer 6 are applied to the encoders 11 and 13, the outputs of which are applied to the multiplexer 12. The multiplexer 12 produces an error correction code to correct a data error on the basis of the outputs from the encoders 11 and 13, and outputs the error correction code together with the outputs from the encoders 11 and 13 in the format, as shown in FIG. 5 and also mentioned above. Namely, the format includes a synchronizing pattern 19, side information section 20, a main information section 21 and an error correction code section 32. The synchronizing pattern 19 shows the beginning of a frame, the side information section 20 includes a predicted parameter, power, the fundamental voice frequency (pitch), etc., and the main information section 21 includes a prediction difference.

The demultiplexer 14 of the decoding section 2 divides into sub-fields the frame received through the transmission channel 3. The decoder 15 decodes divided data existing in sub-field and outputs a prediction difference $\hat{d}'$. The decoder 15*a* decodes a predicted parameter.

The adder 16 adds the prediction difference $\hat{d}'$ and the predicted value $\bar{x}'$ produced by the predictive synthesizing filter 17 to produce an output voice signal $\hat{x}'$, which is then output out of the output terminal 18.

The predictive synthesizing filter 17 produces a predicted value $\bar{x}'$ from the output voice signal $\hat{x}'$ and the predicted parameter decoded by the decoder 15*a*.

The error detector 31 detects an error in the received data, in which case it controls an attenuation parameter $\gamma$ applied to the predictive synthesizing filter 17 to expand the resonant frequency band width of the predictive synthesizing filter 17. The error detector 31 checks an error correction code section 32 output by the demultiplexer 14, and corrects a possible error, and causes the predictive synthesizing filter 17 to perform its regular processing operation with the attenuation parameter $\gamma$ set to 1 (unity). If error correction is impossible, the resonant frequency band width of the predictive synthesizing filter 17 is expanded with the attenuation parameter $\gamma$ set to a value greater than 1 (unity).

Figure 4:
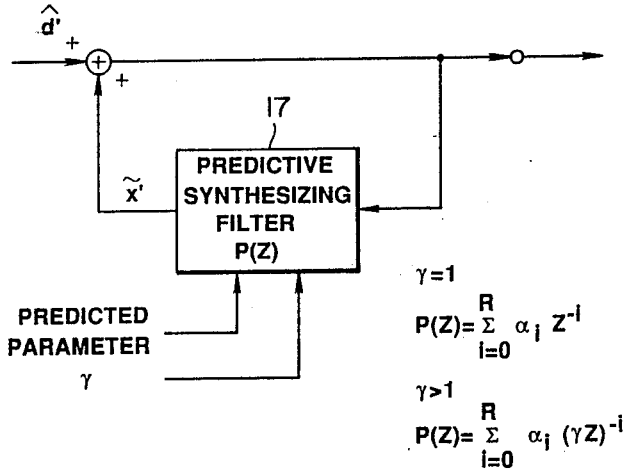
FIG. 4 illustrates a predictive synthesizing filter.

FIG. 4 illustrates the operation of the predictive synthesizing filter 17. Transfer function of the predictive synthesizing filter, a order of prediction, the attenuation parameter, and predictive coefficients are indicated by P(Z), R, $\gamma$ and $\alpha_i$, respectively. If there is no error, the attenuation parameter $\gamma$ is set to 1 (unity), so that $$P(Z) = \sum_{i=0}^{R} \alpha_i Z^{-i}.$$

If there is an error, the attenuation parameter $\gamma$ is set to a value greater than 1 (unity), so that $$P(Z) = \sum_{i=0}^{R} \alpha_i (\gamma Z)^{-i}.$$

Therefore, if a transmission error is detected, the Q value of the predictive synthesizing filter is reduced and the resonant frequency band width of the filter is expanded. Therefore, the output voice is rapidly attenuated, a time in which the influence of an error continues to exist is shortened, and an improved output signal results.

What is claimed is:

1. A voice signal encoding and decoding apparatus comprising:

an encoding section including:

predictive filter means for computing a predicted value of an input signal to the encoding section;

means for computing a difference signal by subtracting from the input signal the predicted value of the input signal computed by the predictive filter means; and means for encoding the difference signal computed by the difference signal computing means; and a decoding section including:

means for decoding a received encoded difference signal;

means for detecting an error in a signal;

predictive synthesizing filter means for computing a predicted value of an output signal;

means for computing the output signal by adding the signal decoded by the decoding means and the predicted value of the output signal computed by the predictive synthesizing filter means; and predictive synthesizing filter control means for expanding a resonant frequency band width of the predictive synthesizing filter means when an error is detected by the error detecting means.

2. A voice signal encoding and decoding apparatus according to claim 1, wherein the encoding section includes means for computing a predicted parameter from the input signal; and wherein the predictive filter means computes the predicted value of the input signal on the basis of the predicted parameter computed by the predicted parameter computing means and the difference signal computed by the difference signal computing means.

3. A voice signal encoding and decoding apparatus according to claim 1, wherein the encoding section includes means for quantizing the difference signal computed by the difference signal computing means, and wherein the encoding means encodes the difference signal quantized by the quantizing means.

4. A voice signal encoding and decoding apparatus according to claim 1, wherein the encoding section includes means for multiplexing and delivering the difference signal encoded by the encoding means and the predicted parameter computed by the predicted parameter computing means.

5. A voice signal encoding and decoding apparatus according to claim 1, wherein the decoding section includes means for extracting the predicted parameter from the received signal; and wherein the predictive synthesizing filter means computes the predicted value of the output signal on the basis of the predicted parameter extracted by the extracting means and the output signal computed by the output signal computing means.

6. A voice signal encoding and decoding apparatus according to claim 1, wherein the decoding section includes means for demultiplexing the difference signal and the predicted parameter from the received signal.

7. A voice signal encoding and decoding apparatus comprising:

an encoding section including:

buffer means for storing a predetermined number of processed samples of an input signal;

means for computing a predicted parameter from the input signal stored in the buffer means;

means for computing a difference signal by subtracting a predicted value of the input signal from the output from the buffer means;

means for quantizing the difference signal computed by the difference signal computing means;

predictive filter means for computing the predicted value of the input signal by using the output from the quantizing means and the output from the predicted parameter computing means;

first encoding means for encoding the output from the quantizing means;

second encoding means for encoding the output from predicted parameter computing means; and means for multiplexing the output from the first encoding means as main information and the output from second encoding means as side information together with an error correction code and delivering the result in a predetermined frame structure; and a decoding section including:

means for demultiplexing from a received signal a frame including the main data, the auxiliary data and the error correction code;

first decoding means for decoding the main information output from the demultiplexing means;

second decoding means for decoding the side information output from the demultiplexing means;

means for computing the output signal by adding the output from the first decoding means and the predicted value of the output signal;

predictive synthesizing filter means for computing the predicted value of the output signal by using the output from the output signal computing means and the output from the second decoding means;

means for detecting an error in the received signal from the error correction code output from the demultiplexing means; and predictive synthesizing filter control means for expanding a resonant frequency band width of the predictive synthesizing filter means when an error is detected by the error detecting means.

8. A voice signal encoding and decoding method comprising the steps of:

computing a difference signal by subtracting a predicted value of an input signal from the input signal;

computing a predicted parameter for the input signal from the input signal;

computing the predicted value of the input signal by using the difference signal and predicted parameter;

encoding the difference signal;

decoding the difference signal from a received signal;

computing the output signal by adding the decoded difference signal and the predicted value of the output signal;

computing the predicted value of the output signal by carrying out a predetermined filtering operation on the computed output signal in accordance with the predicted parameter;

detecting an error in the received signal; and attenuating an erroneous influence rapidly by expanding the resonant frequency band width in the predictive synthesizing step when an error including the error component is detected by the error detecting step.

* * * * *